United States Patent [19]

Humphries

[11] 4,138,674

[45] * Feb. 6, 1979

[54] FOUR WIRE MULTI-SATELLITE INTRUSION ALARM CONTROL SYSTEM WITH TAMPER SWITCH

[75] Inventor: Peter E. Humphries, King, Canada

[73] Assignee: Contronic Controls Limited, Mississauga, Canada

[ * ] Notice: The portion of the term of this patent subsequent to Jul. 18, 1995, has been disclaimed.

[21] Appl. No.: 770,867

[22] Filed: Feb. 22, 1977

[51] Int. Cl.[2] ..... G08B 29/00

[52] U.S. Cl. ..... 340/506; 340/152 T; 343/5 PD; 340/514; 340/552

[58] Field of Search ..... 340/409, 258 R, 258 A, 340/152 T, 408; 343/5 PD

[56] References Cited

U.S. PATENT DOCUMENTS

| | | | |
|---|---|---|---|
| 3,641,547 | 2/1972 | Reiss et al. | 340/409 |
| 3,710,371 | 1/1973 | Whalen et al. | 340/283 |
| 3,786,501 | 1/1974 | Marherakis | 340/409 |
| 3,974,489 | 8/1976 | Bleeker et al. | 340/261 |
| 4,027,303 | 5/1977 | Nenwirth et al. | 343/5 PD |
| 4,032,916 | 6/1977 | Galvin et al. | 340/409 |

*Primary Examiner*—John W. Caldwell, Sr.

*Assistant Examiner*—Donnie L. Crosland

*Attorney, Agent, or Firm*—Rogers, Bereskin & Parr

[57] ABSTRACT

An intrusion alarm system has a number of satellites each connected to a master by an unshielded cable having only four conductors, namely two power conductors, a drive signal conductor which supplies drive to the satellite transmitter and the satellite control circuit, and an alarm conductor. When an intrusion is detected by a satellite, its control circuit transmits a high level alarm signal on the alarm conductor to the master and also enables, but does not operate, a speaker in the satellite. The master has a rocker switch which an investigator turns off when he arrives at the supervised premises. This turns off the drive signal to the satellite. The control circuit of the satellite that caused the alarm responds by sounding its speaker, enabling determination of where the alarm occurred. The rocker switch may also be placed in a walk test position, enabling the system to be walk tested, and then may be returned to its initial supervisory position applying a reset signal to restore the satellite control circuits all to their normal supervisory condition. A tamper switch operates if a satellite is tampered with and causes transmission of a high level tamper alarm signal, different from the intrusion alarm signal, to the master.

9 Claims, 16 Drawing Figures

FOUR WIRE MULTI-SATELLITE INTRUSION ALARM CONTROL SYSTEM WITH TAMPER SWITCH

This invention relates to a four wire satellite control system for a multi-satellite intrusion alarm and is an improvement to the invention disclosed in my co-pending application Ser. No. 742,047 filed Nov. 15, 1976 for "Multi-Satellite Intrusion Alarm Control System".

Intrusion alarms normally operate by transmitting a wave field (typically ultrasonic or electramagnetic radiation) into an area under supervision, receiving a portion of the reflected field, and comparing the two. If a moving intruder is present, a doppler shift is detected in the received field. The doppler frequency is processed and is used to produce an alarm signal.

Since each transmitter-receiver unit can supervise only a relatively small area, such as a room or hall, therefore in large buildings a number of separate units must be used. To reduce duplication of equipment, it is usual to provide a master unit and a number of separate satellites connected to the master unit. A satellite unit is placed in each area to be supervised. The satellites carry out some signal processing, but it is the practice to place some of the signal processing circuits in the master where they provide common processing for several satellites.

A disadvantage of conventional multi-satellite intrusion alarms is that the cables connecting the satellites to the master usually require numerous separate conductors. These cables are therefore expensive, bulky, and difficult to instal. In addition, conventional systems usually require that the connecting cables between the satellites and the master be shielded (since low level signals are being transmitted to the master for further analysis), increasing further the expense and bulk of the cable. The bulky shielded cables are also difficult to instal unobtrusively.

A still further disadvantage of conventional intrusion alarm systems relates to the practice, in large buildings where many satellites are required, of connecting the satellites to the master in groups. Each group of satellites constitutes a "zone". When one satellite in a zone generates an alarm signal, it is normally difficult to determine which of the satellites in the zone actually generated the alarm. In conventional systems, when a security guard investigates these zones in question, his movement usually causes other satellites in the zone to be triggered. This adds to the difficulty of tracing the movements of the intruder or of analyzing the false alarm which caused the alarm signal.

Accordingly, it is an object of the invention to provide an intrusion alarm control system in which, in a preferred embodiment, each satellite is connected to the master by only four wires, which normally need not be shielded. One of the wires supplies power to the satellite; a second is a common return line; the third wire is a drive signal line which carries a drive signal from the master to the satellite; and the fourth is an alarm line which carries a high level alarm signal from the satellite to the master. In a preferred embodiment of the invention a tamper switch is provided in each satellite. If the satellite is tampered with (by removal of its cover), the tamper switch will cause a different high level alarm signal to be transmitted from the satellite to the master over the alarm line. The master detects such different alarm signal and generates an appropriate alarm which is transmitted to an alarm company or to police headquarters or as desired.

Further objects and advantages of the invention will appear from the following disclosure, taken together with the accompanied drawings, in which.

GENERAL DESCRIPTION

Figure 1:
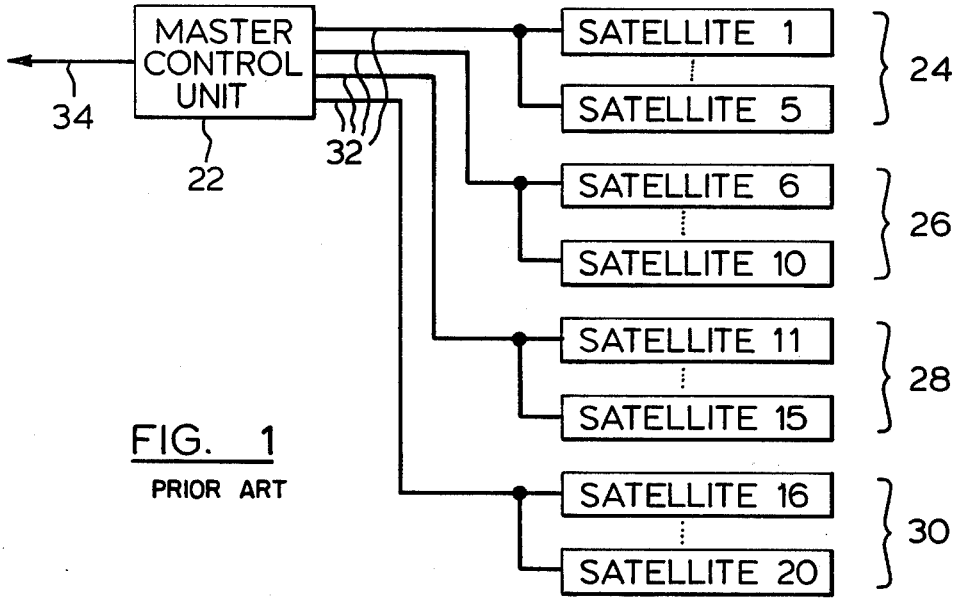
FIG. 1 PRIOR ART
FIG. 1 is a block diagram showing a conventional connection arrangement of satellites to a master control unit.

Reference is first made to FIG. 1, which shows a typical connection system for a master control unit and satellites. The connection system of FIG. 1 has been used in most conventional alarm systems and is preferably also used in the alarm system of the invention. As shown, a master control unit 22 is connected to four satellite zones 24, 26, 28, 30. Each satellite zone typically consists of five satellites, which are indicated as satellites 1 to 5, 6 to 10, 11 to 15 and 16 to 20. The satellites of each zone are connected together and to the master control 22 by cables 32.

In operation, if an intruder is detected by any satellite in a zone, for example in satellite 1 of zone 24, a signal (which in conventional systems usually requires further analysis) is sent to the master control unit 22. The master control unit 22 generates an appropriate alarm signal, which may be sent by a telephone line 34 either to the alarm company whose duty it is to supervise the premises in question, or to police headquarters, or as desired.

As indicated previously, the cables 32 connecting the satellites to the master are usually shielded, and usually contain numerous conductors. Because of this, installation of the satellites is usually a difficult and expensive task.

Figure 2:
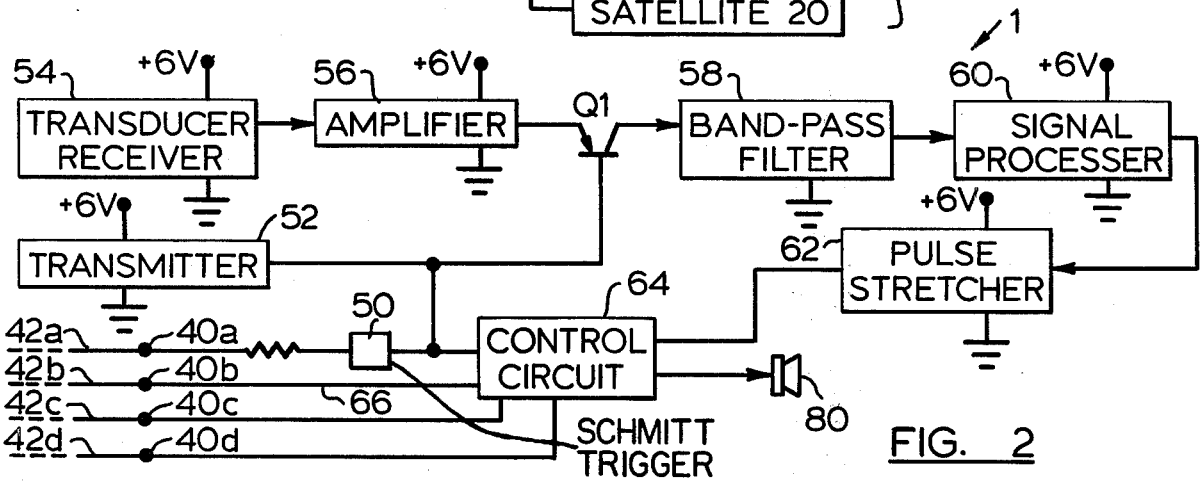
FIG. 2 is a block diagram of a satellite according to the invention.
Figure 3:
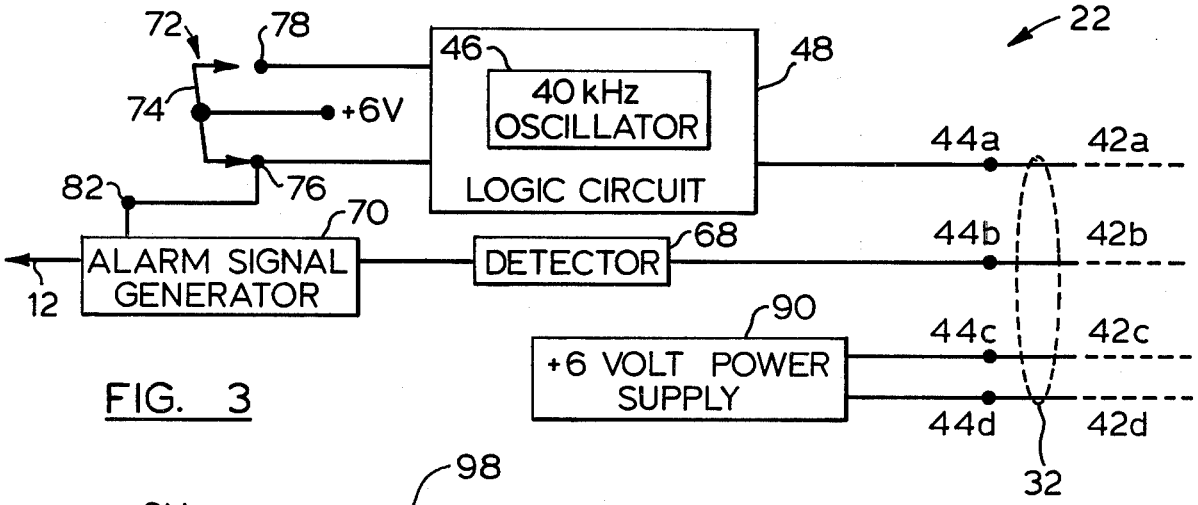
FIG. 3 is a block diagram showing a portion of a master control unit of the invention.

According to the invention, means are provided in the satellites and in the master control unit 22 so that the cable 32 need contain only four conductors. These means are shown in block diagram form in FIGS. 2 and 3. FIG. 2 shows a typical satellite, for example satellite 1 of zone 24. Satellite 1 includes four terminals 40*a*, 40*b*, 40*c*, 40*d* which are conducted by conductors 42*a*, 42*b*, 42*c*, 42*d* to four corresponding terminals 44*a*, 44*b*, 44*c*, 44*d* in the master 22 (FIG. 3). As will be explained, conductor 42*a* is a drive conductor, conductor 42*b* is an alarm conductor, and conductors 42*c*, 42*d* are power supply conductors.

In the example here illustrated, it is assumed that the transmitted field is ultrasonic sound at a frequency of 40 KHz. Accordingly, the master 22 includes a 40 KHz transmitter 46, which forms part of a logic circuit 48. The transmitter 46 applies a 40 KHz drive signal to terminal 44*a*, and thence through drive conductor 42*a* to terminal 40*a* of the satellite 1. In satellite 1 the 40 KHz signal is squared by a Schmitt trigger 50, which improves the waveform of the drive signal and ensures that its peak amplitude is constant. The 40 KHz signal is then sent to transmitter 52 (FIG. 2), which radiates a 40 KHz ultrasonic sound field.

A portion of the reflected field is received by a transducer-receiver 54, amplified by amplifier 56, and then directed to a synchronous detector consisting of transistor Q1. The base of transistor Q1 is driven by the 40 KHz drive signal. The signal from the transistor Q1 collector is passed to a band pass filter 58, which removes the 40 KHz component and also removes very low frequencies. The signal from the band pass filter 58 is then directed to a signal processor 60. The signal processor 60 processes the signal from filter 58 and produces an alarm signal if the signal from filter 58 contains the doppler frequencies which are likely to have been generated by a moving intruder (40 Hz to 300 Hz for a 40 KHz transmitted sound field). Various known forms of signal processing circuits may be used for processor 60. A preferred signal processing circuit is shown in my co-pending application Ser. No. 742,048 filed Nov. 15, 1976 for "Filter system and method for intrusion alarm".

The alarm signal (if any) from signal processor 60 may be extremely short duration, so it is directed into a pulse stretcher 62 (typically a Schmitt trigger) which produces a pulse of fixed length when it is triggered. The pulses (if any) from the pulse stretcher 62 are fed to a control circuit 64, which then sends an appropriate high level signal back to the master 22 via conductor 66, terminal 40*b*, alarm conductor 42*b*, and terminal 44*b*. This signal is received in in the master by a detector 68, which then provides a signal to operate an alarm signal generator 70. The signal from generator 70 may be of any desired form, e.g. it may operate a telephone to alert the alarm company.

As shown in FIG. 3, the logic circuit 48 includes a three position rocker switch 72 having a rocker element 74. The three positions of rocker switch 72 are (i) the position shown in FIG. 3, in which rocker element 74 contacts lower terminal 76, (ii) a position in which rocker element 74 contacts upper terminal 78, (iii) a central position in which rocker element 74 contacts neither of terminals 76, 78. The position shown in FIG. 3 is the normal supervisory position. In this position, rocker switch 72 controls logic circuit 48 so that the 40 KHz signal from oscillator 46 is applied to terminal 44*a*.

If an alarm signal is produced by generator 70, and after an authorized person arrives at the premises to investigate, he will place rocker switch 72 in its central position, in which rocker element 74 does not contact either of terminals 76, 78. As will be explained, the logic circuit 48 then removes the 40 KHz drive signal from terminal 44*a*, so that the satellite 1 (and the other satellites in zone 1) will no longer generate an alarm. This enables the person to investigate the premises protected by zone 1 without creating additional alarms. (He may also switch the corresponding rocker switches for the other zones to their central positons, thus also preventing any of the other satellites from generating an alarm signal. One switch actuator may be used for the rocker switches of all the zones.)

When the authorized person switches off the 40 KHz drive signal at the master 22, the control circuit 64 of FIG. 2 responds to the combination of the terminated 40 KHz drive signal, and the alarm signal which was previously received from pulse stretcher 62, and operates a speaker 80 in the satellite. Thus, when the investigating person walks through the area supervised by the satellite which generated the alarm signal, he will hear the speaker 80 and will know which satellite generated the alarm.

When the investigator moves rocker element 74, power is removed from terminal 82 of alarm signal generator 70. This, by conventional means, places generator 70 in a constant alarm condition, so that the alarm company will know that the system is not in its normal supervisory condition.

After the investigating person has completed his investigation, he can then place the system in a "walk test" condition by moving the rocker switch 72 so that the rocker element 74 contacts terminal 78. This operates the logic circuit 48 of FIG. 3 to resume supply of the 40 KHz drive signal to the satellites, including the satellite 1 of FIG. 2. The control circuit 64 of satellite 1 reacts to the resumption of the 40 KHz drive signal at terminal 40*a* by altering the control of the speaker 80, so that the speaker 80 will now be operated whenever an alarm pulse from pulse stretcher 62 is produced. Therefore, as the investigator walks through the area supervised by satellite 1, he can test and determine the extent of coverage of satellite 1 and whether it is operating properly or generating false alarms. The same applies to the other satellites in zone 1 (and in any other zones where rocker switches have been moved to the "walk test" position).

After the walk test has been completed, the investigator moves the rocker switch 72 back to its original position, in which rocker element 74 contacts terminal 76. This causes the logic circuit 64 to send a timed reset signal along drive conductor 42*a*, as will be described, to actuate the control circuit 48 of each satellite to resume its original supervisory mode of operation. Power is also reapplied via terminal 82 to the alarm signal generator 70.

As will also be described, during the time when the satellite is not generating an alarm signal, its control circuit sends a supervisory signal over alarm conductor 42*b* to the master 22. If the supervisory signal ceases for example because the cable 32 is cut or short circuited, this operates the detector 68 which causes the alarm signal generator 70 to operate. Similarly, if for some reason the 40 KHz drive signal from the master 22 to the satellite 1 ceases, the control circuit 64 of the satellite reacts by ceasing to apply the supervisory signal to terminal 40*f* again causing detector 68 to operate.

The remaining two conductors 42*c*, 42*d* of FIGS. 2, 3 supply +6 volts and a common return respectively to the various components shown in FIG. 2. These two conductors are shown as connected directly to a six volt power supply 90 in the master 22, and are indicated as being connected to the components of FIG. 3 by the diagramatic showing of these components as being connected to +6 volts and ground.

DETAILED DESCRIPTION

A — Circuit Description

Figure 5:
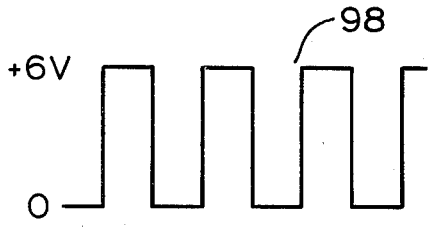
FIG. 5 shows a drive wave form produced at a satellite.
Figure 4:
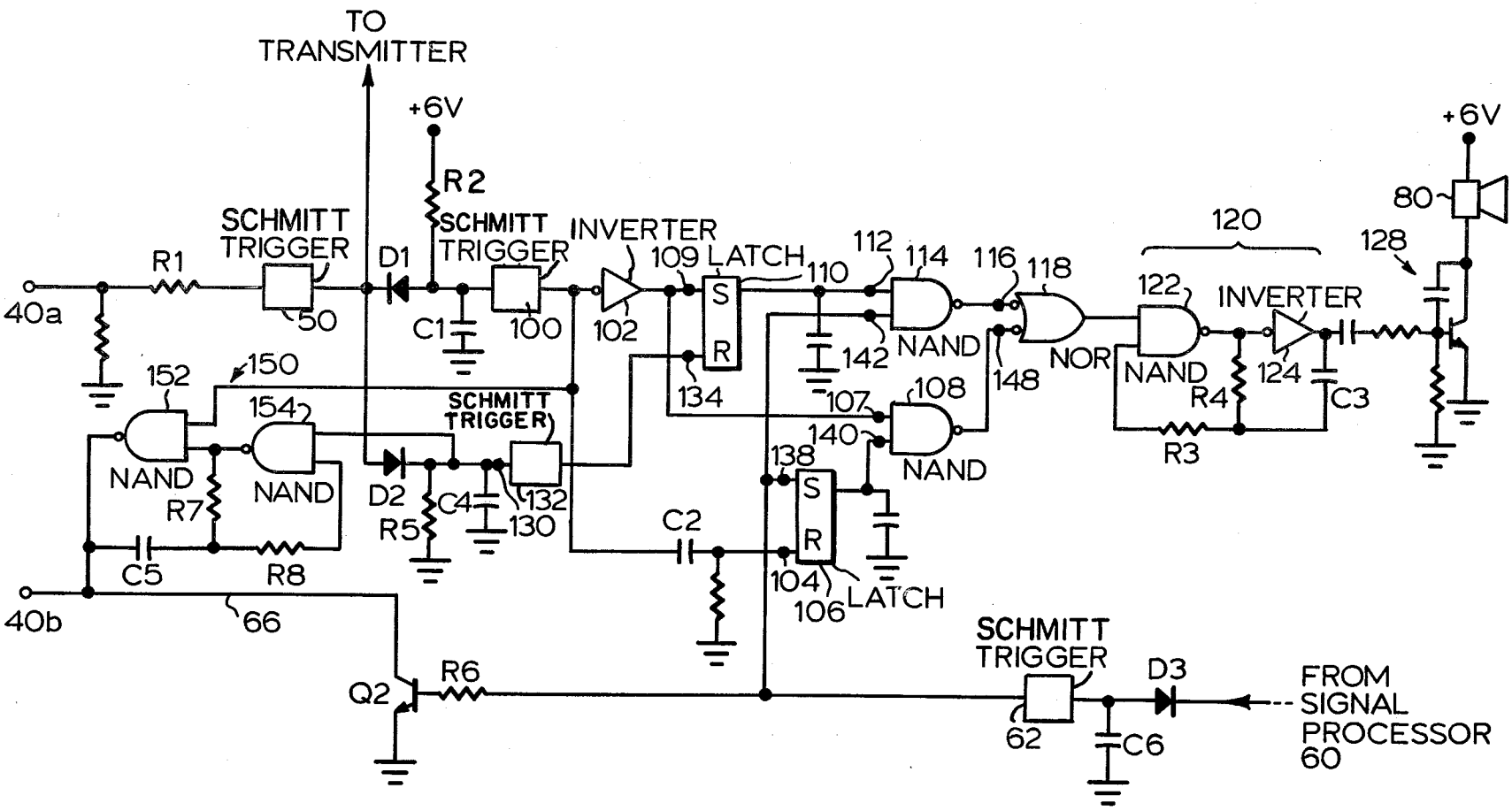
FIG. 4 is a schematic of a control circuit of a satellite.

Reference is next made to FIG. 4, which shows in detail the satellite control circuit 64. As shown in FIG. 4, the 40 KHz drive signal from terminal 40*a* is fed through resistor R1 to the Schmitt trigger 50, which produces a constant peak amplitude square wave train 98 (FIG. 5) from the drive signal. The wave train 98 is fed to the transmitter 52 and the base of transistor Q1, as described, and is also fed through diode D1 to the input of a second Schmitt trigger 100. The positive side of diode D1 is connected through resistor R2 to the +6 volt supply and is also connected through capacitor C1 to ground.

The output of Schmitt trigger 100 is fed to an inverter 102 and also through capacitor C2 to the reset terminal 104 of a memory latch 106. The output of the inventer 102 is fed to one input 107 of a NAND gate 108, and also to the set terminal 109 of a second memory latch 110. The output of latch 110 is directed to one terminal 112 of a NAND gate 114. The output of the NAND gate 114 is fed to one input 116 of NOR gate 118. The output of NOR gate 18 is directed to the input of an oscillator 120 (typically 5KHz) consisting of NAND gate 112, inverter 124, resistors R3 and R4, and capacitor C3. The output of the oscillator 120 is fed through amplifier 128 to the speaker 80.

The square wave train from the input trigger 50 is also fed through a second diode D2 to the input 130 of another Schmitt trigger 132. The input 130 of the Schmidt trigger 132 is connected to ground, through the parallel combination of resistor R5 and capacitor C4. The output of Schmidt trigger 132 is connected to the reset terminal 134 of the memory latch 110.

The output of Schmitt trigger 62 (the pulse stretcher) is connected to the set terminal 138 of memory latch 106 and also to an input terminal 142 of NAND gate 114. The output of latch 106 is connected to an input terminal 140 of NAND gate 108. The output of NAND gate 108 is connected to input 148 of NOR gate 118.

The output of Schmitt trigger 62 is also connected through resistor R6 to the base of transistor Q2, the collector-emitter circuit of which is connected between ground and terminal 42*b*.

Finally, the FIG. 4 circuit includes a 10 Hz oscillator 150, consisting of NAND gates 152, 154, timing resistors R7 R8, and timing capacitor C5. Oscillator 150 applies a 10 Hz signal to terminal 40*b* so long as the 40 KHz signal is present at terminal 40*a*, as will be explained.

B — Operation — Supervisory Condition

The detailed operation of the FIG. 4 circuit is as follows. So long as the 40 KHz driving signal is present at terminal 40*a*, Schmitt trigger 50 produces the square wave signal 98 shown in FIG. 5, varying between +6 volts (when the driving signal is low), and ground (when the driving signal is high). Signal 98 maintains capacitor C1 discharged so long as the 40 KHz driving signal is present at terminal 40*a*. This is because diode D1 is reversed by the "on" half cycles of signal 98, permitting capacitor C1 to charge slowly through resistor R2 during "on" half cycles, but during "off" half cycles diode D1 is forward biased, discharging capacitor C1 through diode D1 and through a low resistance connection to ground (not shown) which is made in the Schmitt trigger 50.

The opposite situation prevails with regard to capacitor C4. This capacitor is normally charged, since during "on" half cycles of signal 98, diode D2 is forward biased, permitting rapid charging of capacitor C4, while during "off" half cycles, diode D2 is reverse biased, causing capacitor C4 to discharge slowly through resistor R5.

Figure 6:
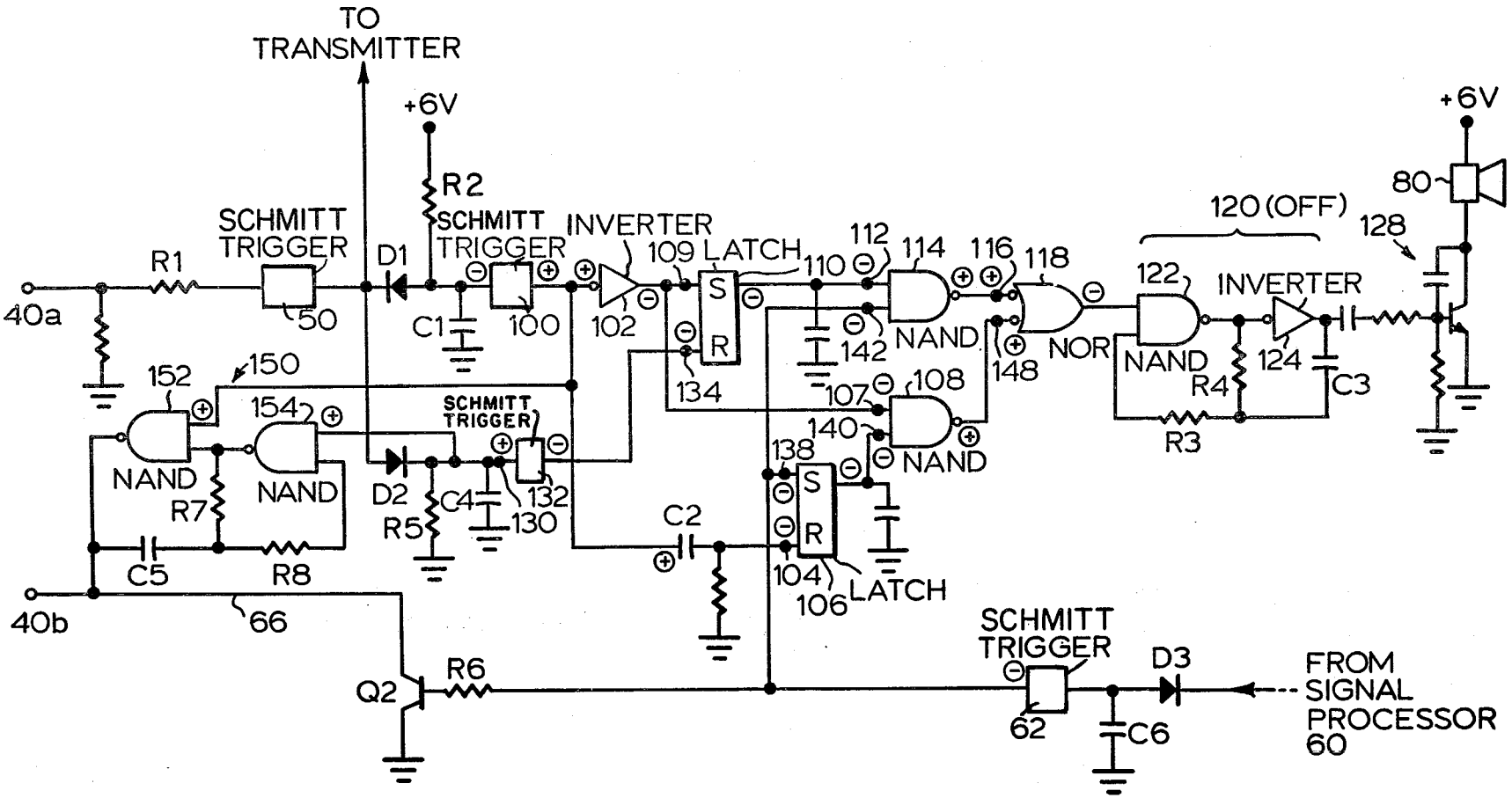
FIG. 6 shows a portion of the control circuit of FIG. 4 in supervisory condition with the condition of certain logic elements indicated thereon.

So long as capacitor C1 remains discharged, the output from Schmitt trigger 100 is high (i.e. +6 volts), since it is an inverting trigger, and the output from inverter 102 is low (i.e. ground), so the memory latch 110 is not set. Latch 110 therefore applies a low to input 112 of NAND gate 114. Inverter 102 also applies to a low to input 107 of NAND gate 108. The output of NAND gate 108 is now high, applying a high to the second input 148 of NOR gate 118. So long as both inputs of NOR gate 118 are high, the output of gate 118 is low, inhibiting oscillator 120. The speaker 80 therefore remains silent. This situation is shown in FIG. 6, in which highs are indicated by + signs and lows are indicated by — signs.

In addition, so long as the 40 KHz driving signal is present, a high is applied from Schmitt trigger 100 to NAND gate 152 of 10 Hz oscillator 150, and a second high is applied from the input of trigger 132 to NAND gate 154 of oscillator 150. Oscillator 150 operates in conventional manner to apply a 10 Hz square wave train of about 6 volts amplitude to terminal 40*b*. The 10 Hz wave train is transmitted to the master 22 (FIG. 3) and received by the detector 68. So long as the detector 68 receives the 10 Hz signal, it will not operate the alarm signal generator 70.

C — Supervisory Condition — Alarm

If an intrusion occurs, causing a high pulse (+ 6 volts) from Schmitt trigger 62, this pulse turns on transistor Q2 for the duration of the pulse. Transistor Q2 grounds terminal 40*b*, stopping transmission of the 10 Hz signal from oscillator 150 to the detector 68. The absence of the 10 Hz signal triggers the detector 68, causing it to operate the alarm signal generator 70.

Figure 7:
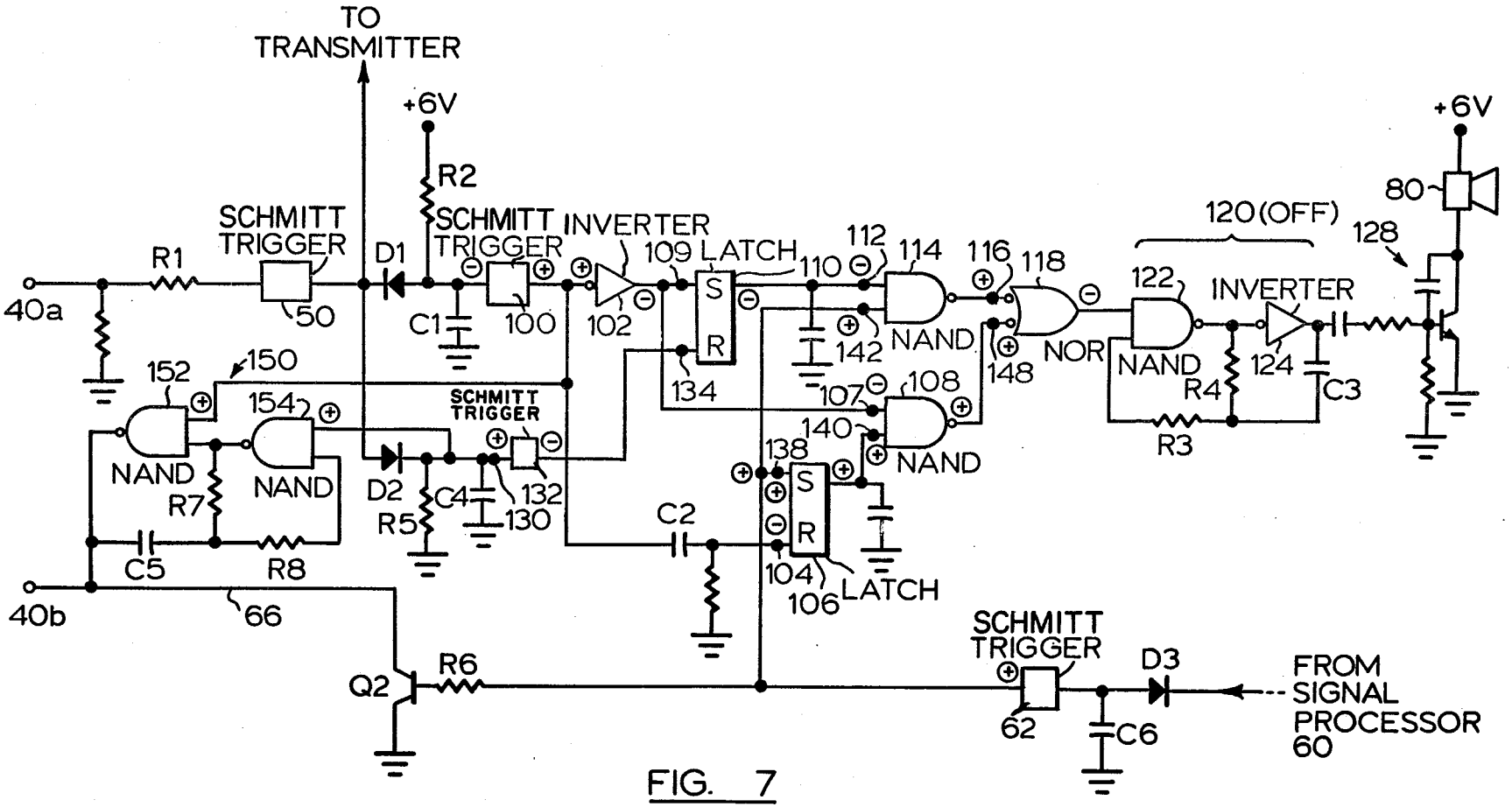
FIG. 7 shows the FIG. 6 circuit in alarm condition.

In addition, the high from Schmitt trigger 62 is applied to one input 142 of NAND gate 114 (See FIG. 7). However, since the other input 112 to gate 114 remains low (since latch 110 has not been set), the output from gate 114 remains high. There is, therefore, no change in the output of NAND gate 114 that would cause NOR gate 118 to remove the inhibit signal (a low) from oscillator 120.

The high from Schmitt trigger 62 also acts to set latch 106 (see FIG. 7) placing a high on input 140 of NAND gate 108. However, input 107 of NAND gate 108 remains low (due to inverter 102) and the output of gate 108 remains high, and again there is no change in the condition of NOR gate 118. The speaker 80 thus remains silent, so as not to alert the intruder, although an alarm has been transmitted to the master and hence to the alarm company.

D — Drive Signal OFF

When an authorized person responds to the alarm and arrives at the supervised premises to investigate, he will move the rocker switch 72 (FIG. 3) to its intermediate position to shut off the 40 KHz drive signal. This shuts off the transmitters of all of the satellites and prevents them from responding to further movement. In addition, when the 40 KHz drive signal is shut off, the output from trigger 50 stays high; diode D1 remains reverse biased, and capacitor C1 charges through resistor R2, producing a low at the output of trigger 100.

Figure 8:
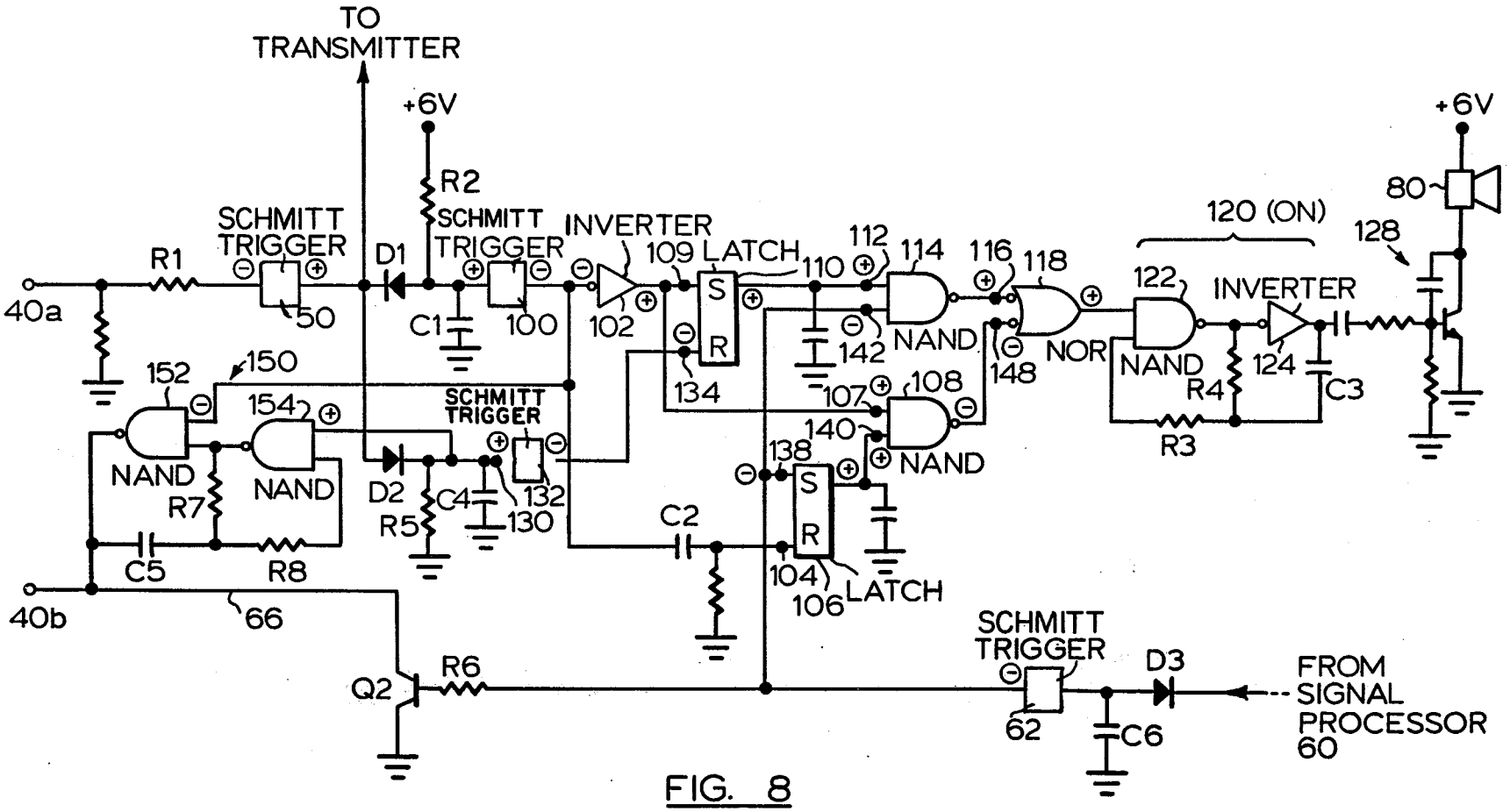
FIG. 8 shows the FIG. 6 circuit with the drive signal off.

The low at the output of trigger 100 produces a high at the output of inverter 102 (see FIG. 8) setting latch 110 and also applying a high to input 107 of NAND gate 108. Since latch 106 was set by the previous alarm pulse from trigger 60, and applies a second high to input 140 of NAND gate 108 (see FIG. 8) gate 108 now has two high inputs. Its output therefore goes low, applying a low to input 148 of NOR gate 118. The output of NOR gate 118 now goes high, enabling oscillator 120. The output of the oscillator 120 is amplified by amplifier 128 and is fed to speaker 80. Thus, when the investigator reaches the area which the satellite 1 supervises, he will hear its speaker and will know that the intruder was in that area or that it generated a false alarm. If the speakers of any other satellites are sounding, he will also know that these satellites generated alarm signals. No other alarm signals will be generated, because the 40 KHz driving signal has been turned off. It will be seen that speaker 80 sounded when two conditions occurred, namely (1) an intrusion was previously detected, and (2) the 40 KHz drive signal was turned off.

E — Walk Test

After the investigation has been completed, it will normally be desired to walk test the system, to ensure that it is operating properly. At this time, the rocker switch 72 (FIG. 3) is moved so that its rocker element 74 contacts terminal 78. This turns on the 40 KHz drive signal again, again discharging capacitor C1.

Figure 9:
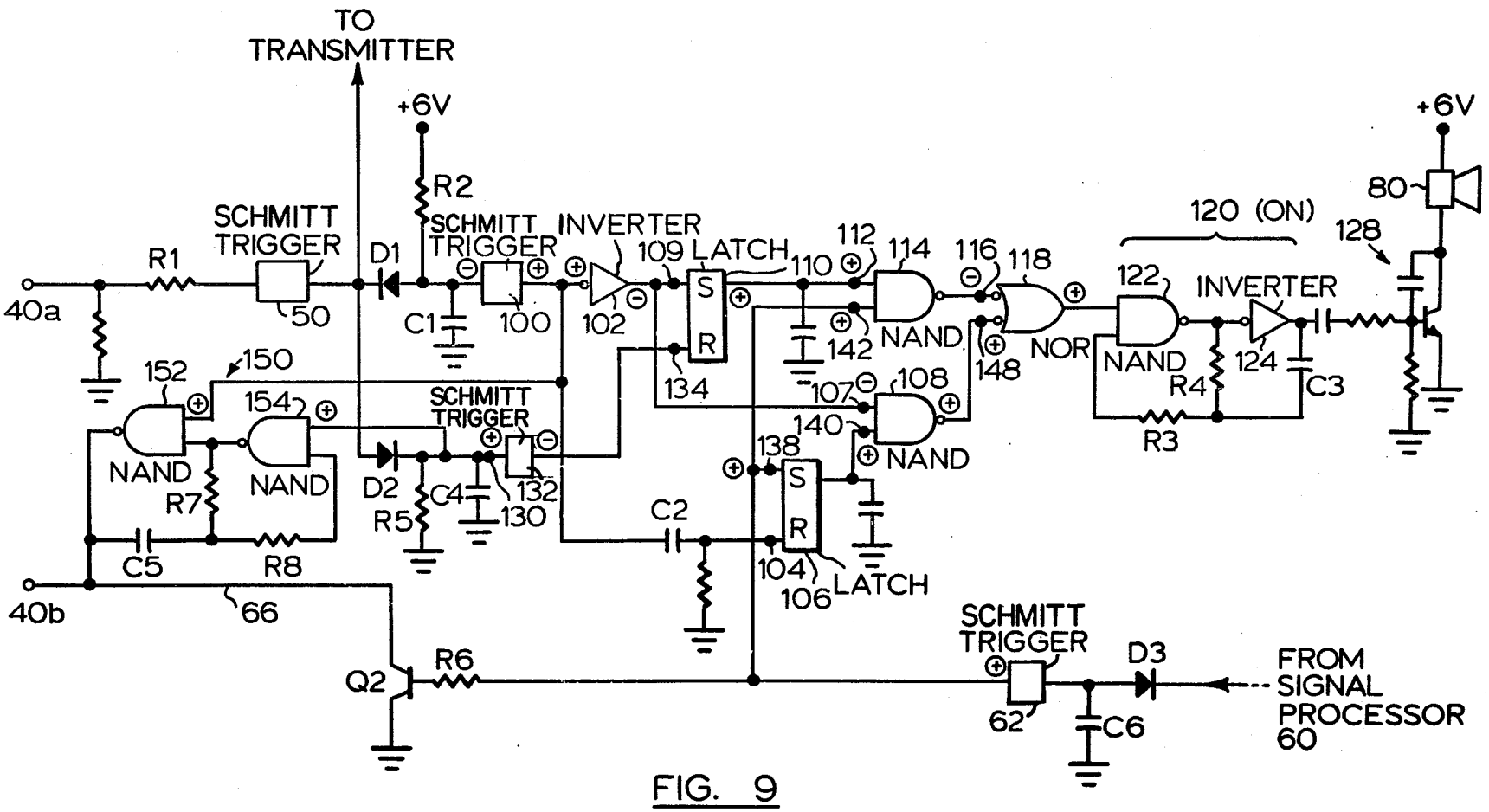
FIG. 9 shows the FIG. 6 circuit in walk test condition.

When capacitor C1 is discharged, trigger 100 goes high (see FIG. 9), resetting memory latch 106 through capacitor C2. Now, with the 40 KHz drive signal available to the satellites, when the authorized person moves in the area supervised by the satellite 1, a high is produced by trigger 62 and is fed directly to input 142 of NAND gate 114. The other input 112 to NAND gate 114 is also high, since latch 110 was set when the 40 KHz drive was turned off previously. The two high inputs to NAND gate 114 produce a low at its output. This low is applied to input 116 of NOR gate 118, which then removes the inhibit from the oscillator 120. The result is that the speaker 80 sounds during the time when the authorized person is actually moving in the area under supervision. This enables testing of the satellite in question and also facilitates setting of the levels at which it will generate an alarm signal.

F — Return to Supervisory Condition

After the walk testing has been completed, and the system is to be placed back into its supervisory condition, the rocker switch 72 is returned to its original condition shown in FIG. 3. By means to be described, this produces a timed 0.4 second low signal on drive conductor 42, followed by a timed 0.4 second high signal, followed by the normal 40 KHz drive signal. The timed 0.4 second high signal is sufficient for capacitor C1 to discharge to its normally discharged condition and is also sufficient time for capacitor C4 to discharge through resistor R5, causing the output of the second trigger 132 to go high. This places a high signal on the reset terminal 134 of latch 110, resetting this latch and thereby disabling any further enunciation of the speaker 80. When the 40 KHz drive signal resumes, after the timed signals, the system is back in supervisory condition.

G — Description of Master Logic Circuit

Figure 10:
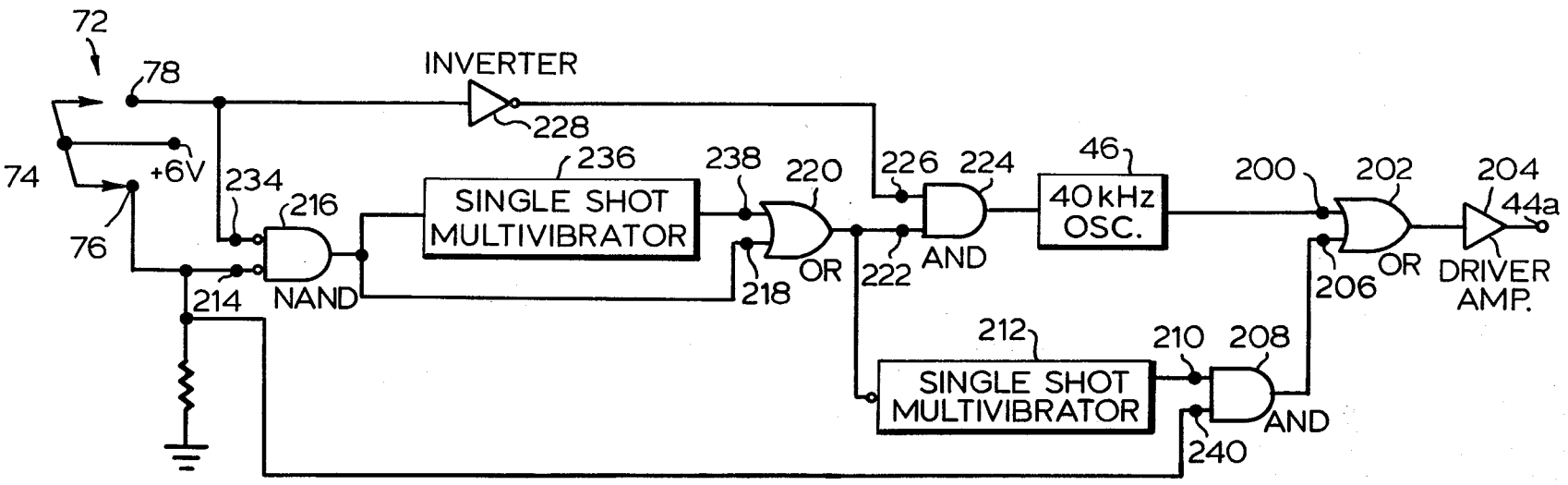
FIG. 10 is a schematic of a logic circuit of a master control unit.
Figure 11:
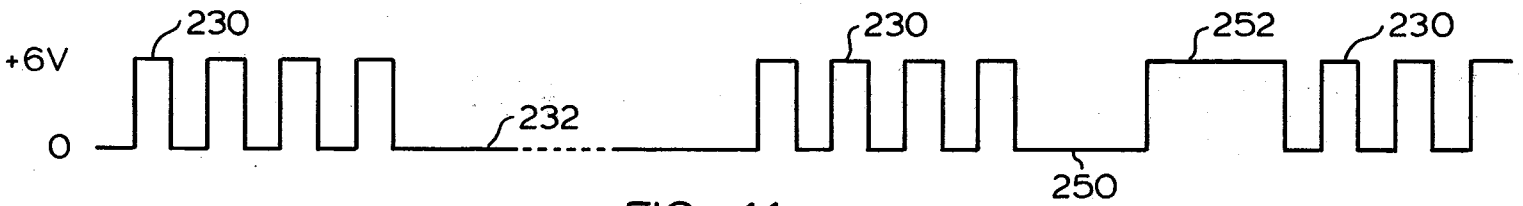
FIG. 11 shows wave forms produced by the logic circuit of FIG. 10.

The logic circuit 48 of the master 22, and the wave forms produced thereby, are shown in detail in FIGS. 10 and 11. When the rocker switch 72 is in the position shown the 40 KHz oscillator 46 operates and its signal is fed to input 200 of OR gate 202 to operate driver amplifier 204. Amplifier 204 then feeds the amplified 40 KHz drive signal to the drive terminal 44*a*. There is no input to the second input 206 of OR gate 202 at this time, because input 206 is fed by AND gate 208, one input 210 of which is a single shot multivibrator 212 which is not operative at this time.

When the rocker switch 72 is operated so that its rocker element 74 is in its intermediate position, in which element 74 does not contact either terminal 76, 78, then +6 volts is removed from the second input 214 of NAND gate 216. Gate 216 is a negative logic NAND gate which produces a high at its output only when both its inputs are low, i.e. it functions like a positive logic NOR gate. Both the inputs of NAND gate 216 are now low, thereby producing a high at the input 218 of OR gate 220, which in turn produces a high at the input 222 of AND gate 224. The second input 226 of AND gate 220 is also high at this time, because of inverter 228, the input of which is grounded through resistor R10. The output of AND gate 224 therefore goes high, inhibiting the 40 KHz oscillator 46, which ceases operation. When oscillator 46 turns off, the drive terminal 44*a* is grounded by means not shown in the driver amplifier 204.

The wave forms thus produced at drive terminal 44*a* are shown in FIG. 11. The 40 KHz drive signal is shown at 230, and the ground signal produced when the 40 KHz oscillator 46 is inhibited is shown at 232. As described, when the 40 KHz oscillator 46 is inhibited, an investigator can walk into the supervised area without causing a further alarm.

When the rocker switch 72 is switched to its walk test condition, in which rocker element 74 contacts terminal 78, this supplies a high to the input of inverter 228, causing its output to go low, so that input 226 of AND gate 224 goes low. AND gate 224 therefore removes the inhibit or high signal from oscillator 46, and the drive terminal 44*a* now receives the 40 KHz drive signal again. As previously described, the satellites will now detect motion and the speakers 80 will sound at the time when the motion occurs, so that the system can be walk test. In addition, input 234 of NAND gate 216 goes high and input 214 of this gate goes low, causing the output of gate 216 to go low.

To return the system back to supervisory position, the rocker switch 72 is returned to its position as shown in FIG. 10. As the rocker element 74 moves, both inputs 214, 234 to NAND gate 216 are low for a brief interval. The output of gate 216 therefore goes high for a brief interval and triggers a single shot multivibrator 236 which produces a 0.4 second high output pulse. This high pulse at input 238 of OR gate 220 produces a 0.4 second high at input 222 of AND gate 224. AND gate 224 now has two high inputs (input 222 from OR gate 220 and input 226 from inverter 228), so the 40 KHz oscillator 46 is inhibited for 0.4 seconds. The 0.4 second off pulse in the drive signal is indicated at 250 in FIG. 11.

When the single shot multivibrator 236 times out, and since by this time switch 72 will have reached the position drawn, the output of OR gate 220 goes low again, since it will have lows at both its inputs. The low output of OR gate 220 triggers the second single shot multivibrator 212. Multivibrator 212 produces a 0.4 second high pulse at its output. AND gate 208 now has two high inputs, namely input 210 from multivibrator 212, and the other input 240 supplied directly from terminal 76 and the +6 volts supply. AND gate 208 therefore produces a high output for 0.4 second (the timing duration of multivibrator 212) and this applied to input 206 of OR gate 202, produces a high at its output. The high output of OR gate 202, fed to the driver amplifier 204, produces a high pulse 252 (FIG. 11) at drive terminal 44*a* for the timing duration of multivibrator 212 (0.4 seconds).

As soon as multivibrator 212 times out, the high input to input 206 of OR gate 202 is removed, and the normal 40 KHz drive signal 230 is reapplied to the drive terminal 44*a*. The system is now back in normal supervisory operation.

In the system described, it will be seen that the alarm signal transmitted by the satellites to the master is a high level signal, i.e. it is the removal and continued absence of the high level signal produced by oscillator 150. A "high level" alarm signal as here used means a signal which differs by a reasonably substantial amount from the previously prevailing signal, so that even if the signal conductor is unshielded, it will not normally pick up stray signals that would be interpreted as an alarm signal. For example, the difference will usually be at least one volt and preferably higher in a cable of length not exceeding 500 feet. For longer cables, a higher difference will usually be employed. Here, +6 volts has been used for a system in which the cable length is typically up to 1000 feet.

It will also be appreciated that certain features of the invention may be used in systems which transmit low level signals over shielded cables containing more than four conductors. For example, the feature of inhibiting the speaker of a satellite which has detected a disturbance, until the drive signal is turned off, the termination of the drive signal causing that speaker (or other alarm indicator) then to enunciate, may be used in other systems, as may the walk test feature.

H — Tamper Switch

In the system so far described, it is possible that an expert could tamper with a satellite during the day (when signals produced by the alarm signal generator are not normally monitored) and could disable the satellite in a manner such that it would continue to transmit a 10 Hz supervisory signal to alarm signal terminal 40*b*, but would not ground this terminal when an intruder is detected. To prevent this possibility, it is required in some systems that a tamper switch be installed in each satellite. Such a tamper switch operates when the cover of the satellite is removed and causes generation of a tamper alarm signal which is monitored 24 hours per day. In the past, the installation of a tamper switch has required addition of a separate pair of wires from each satellite to the master control unit.

According to the invention, a tamper switch system is provided which utilizes the alarm signal terminal 40*b* and the alarm conductor 42*b*. The original four wire cable 32 is still used; no additional conductors are required. The tamper switch system will be described next, with reference to FIGS. 12 to 16.

Figures 12, 13:
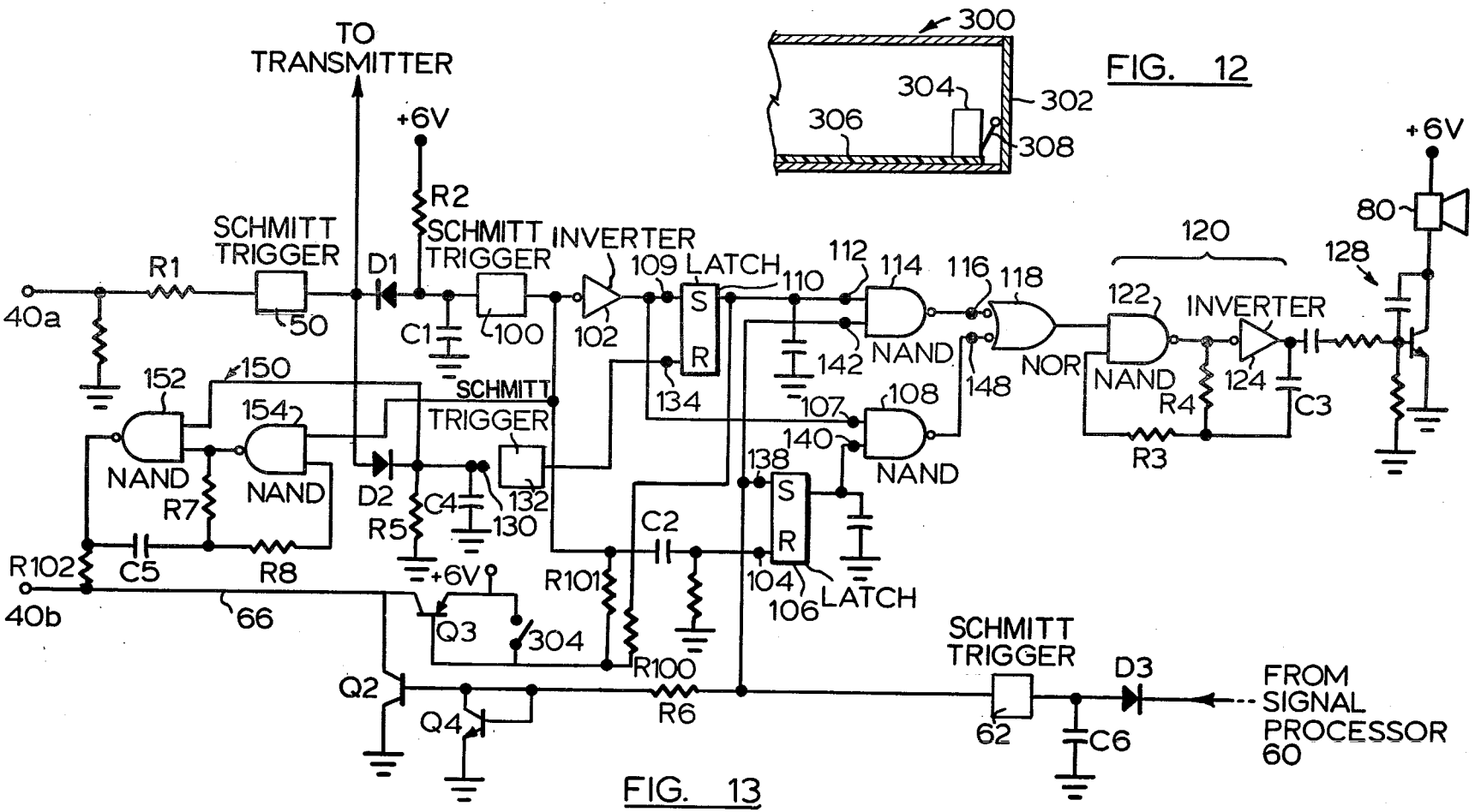
FIG. 12 is a diagrammatic view of the housing of a satellite showing a tamper switch in position therein.
FIG. 13 is a schematic of a control circuit of the satellite of FIG. 12, similar to FIG. 4 but showing the tamper switch circuitry in position.

Reference is first made to FIG. 12, which shows a typical housing 300 for a satellite. The housing 300 includes a cap or cover 302 secured to the remainder of the housing by means not shown and which must be removed if access is desired to the inside of the housing. Located within the housing 300 is a microswitch 304, which constitutes a tamper switch. The tamper switch 304 is secured (by means not shown) on a circuit board 306 which also contains the remainder of the circuitry for each satellite. Projecting from the tamper switch 304 is a spring biased switch element 308 which normally rests against the cover 302. If the cover 302 is removed, the switch element 308 will move outwardly, opening the tamper switch, as will now be described with reference to FIG. 13.

FIG. 13 shows the same control circuit as that of FIG. 4, except for the addition of the tamper switch 304 and associated circuitry, and except for a reversal of the inputs to NAND gates 152 and 154, for a reason to be explained. In FIGS. 13 to 16, corresponding reference numerals are used to indicate parts corresponding to those of FIGS. 1 to 11.

In the FIGS. 1 to 11 system, and also in the FIGS. 13 to 16 system, a supervisory 10 Hz signal is normally applied to alarm terminal 40*b* by oscillator 150. The 10 Hz signal oscillates between ground and +6 volts. When a satellite detects an intruder, that satellite's transistor Q2 grounds its alarm terminal 40*b*. The ground constitutes a high level alarm signal and is detected by detector 68 (FIG. 3). (It may be noted that normally only the oscillator 150 in the last satellite of each group of satellites is coupled to the drive signal terminal 40*a* for operation. For example, in satellite group 24 of FIG. 1, only the oscillator 150 of satellite 5 would be connected. This ensures that all the lines are fully supervised. If oscillators 150 of all of the satellites in the group were connected, then the line to one satellite could be cut without this being detected.)

The tamper switch 304, when it opens, causes a different high level alarm signal to be applied to the alarm terminal 40*b* of its satellite. Specifically, tamper switch 304 when it opens causes a +6 volt signal to be applied to alarm signal terminal 40*b*. The operation is as follows.

In normal supervisory condition, and with the cover 302 closed on housing 300, tamper switch 304 is normally closed. In the normal supervisory condition (section B of the foregoing description), latch 110 is not set, and its output, being low, causes current to flow in resistor R100. This current flows directly through switch 304 to the +6 volt supply, since switch 304 short circuits the base-emitter junction of transistor Q3.

If the cover 302 is now removed, allowing switch 304 to open, the current through resistor R100 will then flow into the base of transistor Q3, turning it on. Transistor Q3 pulls the alarm terminal 40*b* up to +6 volts. The +6 volt signal at terminal 40*b* constitutes a tamper alarm signal which, when transmitted to the master, is detected as will be described.

When several satellites are connected to a single master control unit, the following situation may occur. During the day, when persons are moving about the premises being supervised, several or all of the satellites may transmit alarms by grounding their respective alarm terminals 40*b* through their respective transistors Q2. If at this time one satellite is tampered with and its transistor Q3 attempts to pull its terminal 40b (and the corresponding master terminal 44b) up to +6 volts, this tendency will be counteracted by those satellites which have their transistors Q2 turned on. To ensure that the master control unit terminal 44b is pulled up to +6 volts or to a voltage near +6 volts, means are provided to limit the current through transistor Q2 of each satellite. These means are constituted by transistor Q4 (FIG. 13) which is connected with transistor Q2 to form a current mirror. In this configuration, provided that transistors Q2 and Q4 are well matched, the collector current of transistor Q2 is essentially the same as the current flowing through resistor R6. This current is sufficiently limited that even if transistors Q2 of all five satellites connected to a master control unit are conducting, operation of a transistor Q3 of one of the satellites will pull terminal 44b of the master control unit sufficiently close to +6 volts to operate the tamper switch detector therein (as will be described).

If the 40 KHz drive signal is turned off (section D of the foregoing description), the tamper alarm signal will still be operative. In this condition, latch 110 is set (FIG. 8) and its output is high, so that base current for transistor Q3 cannot be supplied from latch 110. However, the output of trigger 100 is now low, and if tamper switch 304 is open, current flows through resistor R101 to the base of transistor Q3, again turning on transistor Q3.

It should be noted that in the control circuit shown in FIGS. 6 to 9 inclusive, when the drive signal is turned off (section D of the foregoing description), alarm terminals 40b of the satellites normally went to +6 volts (this was the quiescent condition of the oscillators 150). With the tamper switch 304 included in the circuit, this was undesirable. Therefore, as shown in FIG. 13, the input to NAND gates 152, 154 of oscillator 150 have been reversed. The upper input to NAND gate 152 is now connected to the cathode of diode D2, and the upper input to NAND gate 154 is now connected to the output of trigger 100. This reversal of the inputs causes the output of oscillator 150, and hence terminal 40b of the satellites, to be grounded through resistor R102 when the drive signal is turned off. If at this time a tamper switch 304 operates, its transistor Q3 will counteract the effect of oscillator 150 and will pull terminal 40b to +6 volts.

When the system is being walk tested (section E of the foregoing description), tamper circuit operation is not desirable. This is because it is often desired to adjust the sensitivity of the satellites during the walk testing, and the covers 302 may be removed at this time.

In the walk test condition, the outputs of both trigger 100 and latch 110 are high (FIG. 9) and therefore no current is available to operate transistor Q3. Thus, the tamper alarm will not be operative.

Figure 14:
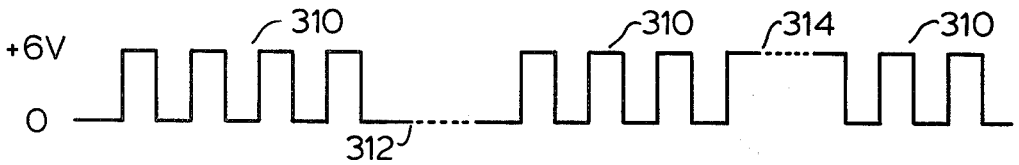
FIG. 14 shows wave forms on the alarm line of the FIG. 13 circuit.

The signals applied to terminal 40b of a satellite are shown in FIG. 14. The normal supervisory 10 Hz signal supplied by oscillator 150 of the last satellite of each group is shown at 310 and oscillates between zero and +6 volts. When one satellite detects an intruder, the ground signal applied to terminal 40b is shown at 312. When a satellite cover is removed, the +6 volt tamper alarm signal is shown at 314.

Figure 15:
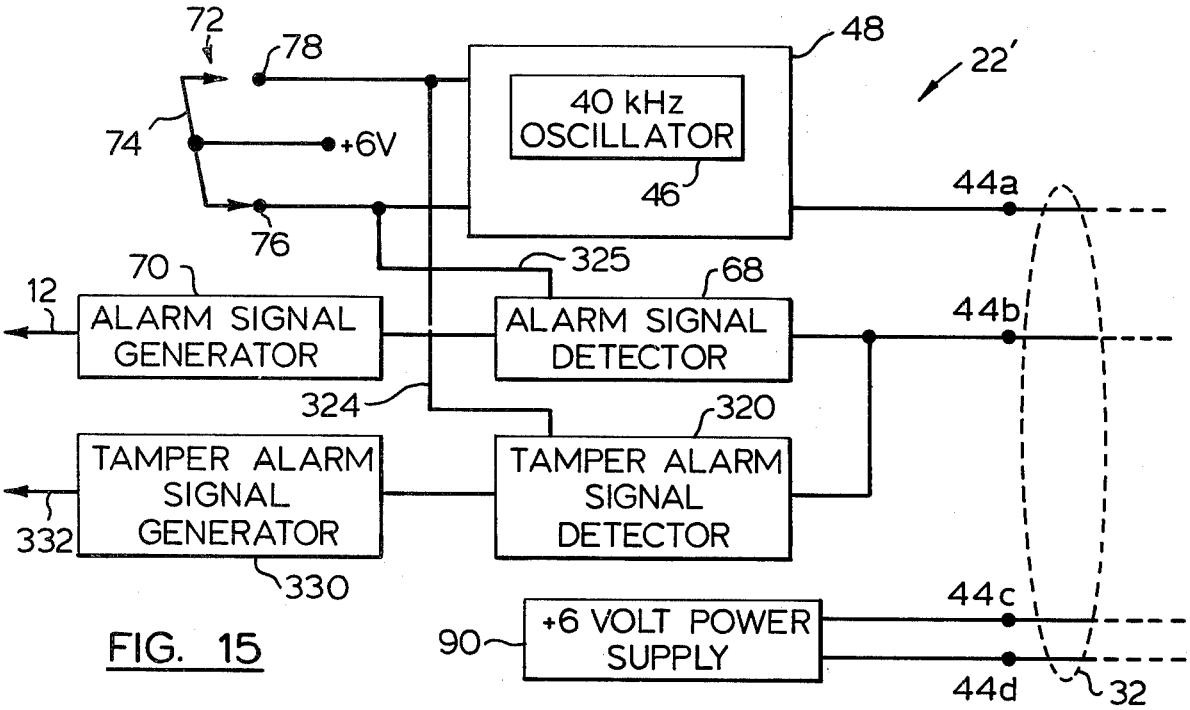
FIG. 15 is a block diagram of a master control unit for use with the FIG. 13 circuit.

Reference is next made to FIG. 15, which shows the master control unit used when the satellites include tamper switches. The master control unit of FIG. 15 is the same as that of FIG. 1 except for minor changes as will be described, and corresponding parts are indicated by corresponding reference numerals. The master control unit as a whole in FIG. 15 is indicated by reference numeral 22'.

The differences between the master control unit 22' and master control unit 22 of FIG. 2 are as follows. Firstly, a tamper alarm detector 320 has been added. The tamper alarm detector 320 is connected to alarm terminal 44b of the master control unit 22' and is also connected via conductor 324 to terminal 78 of rocker switch 72, to alert the supervising station if the rocker switch is moved (as will be described).

In addition, lead 82 from the rocker switch 72 to alarm signal generator 70 has been replaced by a similar lead 325 from rocker switch 72 to the alarm signal detector 68.

When a tamper switch 304 operates, operating a tamper alarm signal detector 320, detector 320 in turn operates a tamper signal generator 330 which transmits an appropriate signal via lead 332 to an alarm company, to police headquarters or to another supervising station as desired.

Figure 16:
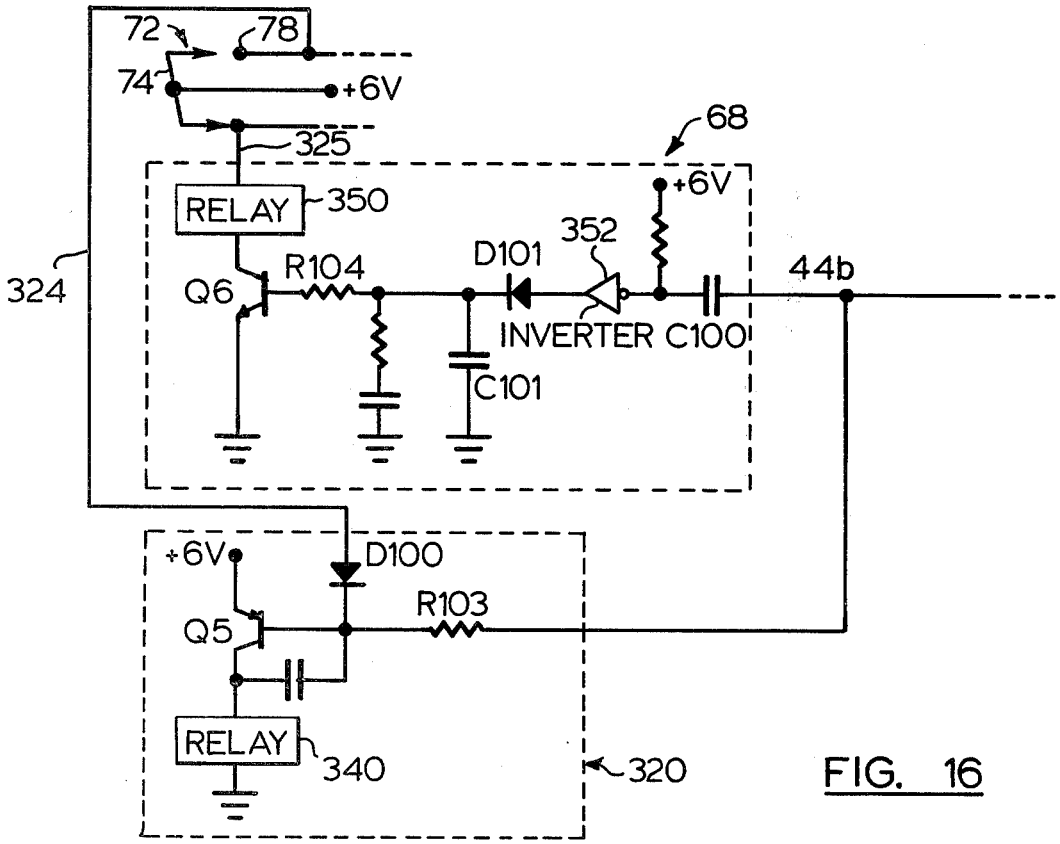
FIG. 16 is a schematic of a portion of the control unit of FIG. 15.

Detailed circuits for the alarm signal detector 68 and the tamper alarm signal detector 320 are shown in FIG. 16. As shown, the tamper alarm signal detector 320 includes a tamper relay 340. So long as alarm terminal 44b is low (which occurs when the drive signal is turned off or when an ordinary alarm occurs), the current through resistor R103 is sufficient to turn on transistor Q5 and maintain the tamper relay 340 energized. Similarly, so long as the system is in supervisory condition, with the drive signal on, the average current generated by the 10 Hz square wave applied to terminal 44b is also sufficient to turn on transistor Q5, again maintaining the tamper relay 340 energized.

When a tamper switch 304 operates, this will cause terminal 44b to go high (+6 volts), removing the current from transistor Q5 and turning off relay 340. A contact of relay 340 (not shown) then operates the tamper alarm signal generator 330.

If the rocker switch 72 is placed in walk test condition, in which rocker arm 74 contacts terminal 78, the base current of transistor Q5 is by-passed through diode D100, again turning off the tamper relay 340 to alert the supervising station of this condition.

The alarm signal detector 68 shown in FIG. 16 will next be described. Detector 68 includes an alarm relay 350 which is normally energized by transistor Q6. The base of transistor Q6 is connected through resistor R104, diode D101, inverter 352 and capacitor C100 to the alarm terminal 44b. So long as the 10 Hz supervisory signal is received at terminal 44b, terminal 44b will oscillate between zero and +6 volts, keeping capacitor C101 charged through diode D101. So long as capacitor C101 remains charged, sufficient base current is provided for transistor Q6 to keep transistor Q6 turned on, keeping alarm relay 350 energized. However, if terminal 44b remains in either a high or low state, current will cease to flow through capacitor C100, and transistor Q6 will turn off, turning off alarm relay 350. Relay 350 will also turn off if rocker switch 72 is moved from its supervisory condition shown in FIG. 16, since the +6 volts supply is then removed from the relay. When relay 350 turns off, its contact (not shown) operates the alarm signal generator 70.

It will be seen that in the FIGS. 13 to 16 embodiment, the single alarm conductor 42b is used to transmit a high level supervisory signal (10 Hz), a high level alarm signal (ground), and a high level tamper alarm signal (+6 volts). Because one wire is used for all three signals, a tamper switch can be added without additional wiring between the master and the satellites, thus greatly simplifying the installation.

What I claim is:

1. An intrusion alarm system comprising:

(1) a master control unit having:

(a) two power supply terminals and power supply means coupled thereto for supplying power to said power supply terminals, (b) a master drive signal terminal, and a drive signal generator coupled thereto for applying a drive signal to said master drive signal terminal, (c) a master alarm signal terminal, and intrusion alarm detector means coupled thereto and responsive to receipt of a predetermined first high level alarm signal thereat for generating an intrusion alarm, (d) tamper alarm detector means coupled to said master alarm signal terminal and responsive to receipt thereat of a second high level alarm signal different from said first high level alarm signal for generating a tamper alarm, (2) a plurality of satellite units, each having:

(a) a satellite drive signal terminal, and a transmitter coupled thereto and responsive to receipt of said drive signal thereat for transmitting a radiation field in a supervised area, (b) a receiver for receiving a portion of said radiation field which is reflected from objects in said area, (c) signal processing means coupled to said receiver for comparing the transmitted and received fields and responsive to disturbances in said received field caused by a moving intruder in the supervised area, for generating a third alarm signal upon occurence of such disturbance, (d) a satellite alarm signal terminal, (e) a control circuit coupled to said signal processing means and to said satellite alarm signal terminal and responsive to receipt of said third alarm signal for generating said first high level alarm signal at said satellite alarm signal terminal, (f) a housing, a cover removable from said housing for providing access to said housing, and a tamper switch within said housing and operable upon removal of said cover, (g) said control circuit including tamper switch detector means connected to said tamper switch and to said satellite alarm signal terminal and responsive to operation of said tamper switch for generating said second high level alarm signal at said satellite alarm signal terminal, (h) two satellite power receiving terminals for receiving power and coupled to said transmitter, and to said receiver, said signal processing means, and to said control circuit for supplying power thereto, (3) a cable having only four wires connecting each satellite unit to said master control unit, two of said wires being connected between said power supply terminals and said satellite power receiving terminals, a third of said wires being connected between said master drive signal terminal and said satellite drive signal terminal, and the fourth of said wires being connected to said master alarm signal terminal and said satellite alarm signal terminal.

2. An intrusion alarm system according to claim 1 wherein said control circuit includes means coupled to said satellite drive signal terminal and responsive to receipt of said drive signal thereat for generating a high level status signal and for applying said status signal to said satellite alarm signal terminal during receipt of said drive signal at said satellite drive signal terminal, said control circuit including means responsive to receipt of said intrusion alarm signal for removing said status signal from said satellite alarm signal terminal and for substituting a first fixed voltage signal, said first fixed voltage signal constituting said first alarm signal.

3. An intrusion alarm system according to claim 2 wherein said tamper switch detector means includes means responsive to operation of said tamper switch for removing said status signal from said satellite alarm signal terminal and for substituting a second fixed voltage signal different from said first fixed voltage signal, said second fixed voltage signal constituting said second alarm signal.

4. An intrusion alarm system according to claim 3 wherein said intrusion alarm detector means includes means responsive to receipt of either said second alarm signal or said first alarm signal for generating said intrusion alarm.

5. An intrusion alarm system according to claim 1 wherein each satellite unit includes an alarm indicator, and each control circuit includes:

(i) enable means responsive to receipt of said third alarm signal for thereupon producing an enable signal, (ii) control means connected to said alarm indicator and normally inhibiting operation of said alarm indicator during receipt of said drive signal at said satellite drive signal terminal, (iii) said control means including first logic means connected to said enable means and responsive to termination of receipt of said drive signal at said satellite drive signal terminal and to the presence of said enable signal, for operating said alarm indicator upon such termination of receipt of said drive signal at said satellite drive signal terminal if said enable signal is then present, whereby said alarm indicator of a satellite normally operates only when both said signal processing means of such satellite has generated said third alarm signal and said drive signal has also ceased to be applied to said drive signal receiving terminal of such satellite.

6. An intrusion alarm system according to claim 5 wherein each control circuit further includes means responsive to resumption of application of said drive signal to said drive signal receiving terminal, following termination of such application, for terminating said enable signal, and said control means further includes:

(A) latch means operative on termination of application of said drive signal to said drive signal receiving terminal for producing a latch-on signal, (B) second logic means coupled to said alarm indicator, and to said latch means, and to said signal processing means and responsive to receipt of said latch-on signal and said third alarm signal together for operating said alarm indicator, each control circuit also including third logic means coupling said latch means to said satellite drive signal terminal for resetting said latch means to inoperative condition on receipt of a reset signal at said satellite drive signal terminal, and said master control unit includes means for selectively applying a said rest signal to said master drive signal terminal, whereby when application of said drive signal to said master drive signal terminal has been terminated and then resumed, then said alarm indicator will operate during movement in the supervised area so that said system may be walk tested, and whereby said latch means may be reset so that said control means will inhibit operation of said alarm indicator in the supervised area when said drive signal is present at said mast drive signal terminal, and each control circuit further includes means connected to said first logic means and to said latch means for disabling said tamper switch detector means upon termination of application of said drive signal and subsequent application of said drive signal without said reset signal, to said master drive signal terminal.

7. An intrusion alarm system according to claim 6 wherein said master control unit includes switch means having three positions, namely a supervisory position, an intermediate position, and a walk test position, and control means coupling said switch means to said drive signal generator and to said master drive signal terminal for producing at said drive signal terminal:

(a) said drive signal when said switch is in said supervisory position, (b) an off signal when said switch is in said intermediate position, (c) said drive signal when said switch is in said walk test position, (d) said reset signal followed by said drive signal when said switch is moved from said walk test position through said intermediate position to said supervisory position.

8. An intrusion alarm system according to claim 7 wherein said means for generating said status signal is an oscillator, said means for removing said status signal from said satellite alarm terminal includes means for grounding said satellite alarm terminal, said first fixed voltage signal thereby being ground.

9. An intrusion alarm system according to claim 1, wherein said cable is unshielded.

* * * * *